US010563327B2

(12) United States Patent
Ding et al.

(10) Patent No.: US 10,563,327 B2
(45) Date of Patent: Feb. 18, 2020

(54) INDUSTRIAL FABRIC

(71) Applicant: ANPING XINPENG MESH BELT LIMITED COMPANY, Hengshui (CN)

(72) Inventors: Qijun Ding, Hengshui (CN); Lingjun Yuan, Hengshui (CN); Peng Xie, Hengshui (CN); Fujun Chen, Hengshui (CN); Xiaolei Chen, Hengshui (CN); Xingran Yuan, Hengshui (CN)

(73) Assignee: ANPING XINPENG MESH BELT LIMITED COMPANY, Hengshui (CN)

( * ) Notice: Subject to any disclaimer, the term of this patent is extended or adjusted under 35 U.S.C. 154(b) by 149 days.

(21) Appl. No.: 15/821,046

(22) Filed: Nov. 22, 2017

(65) Prior Publication Data

US 2018/0094366 A1 Apr. 5, 2018

Related U.S. Application Data

(63) Continuation of application No. PCT/CN2015/093035, filed on Oct. 28, 2015.

(30) Foreign Application Priority Data

May 22, 2015 (CN) ..... 2015 1 0265257

(51) Int. Cl.
*D21F 1/00* (2006.01)
*D21F 7/08* (2006.01)
(Continued)

(52) U.S. Cl.
CPC ..... *D03D 1/00* (2013.01); *D03D 1/0094* (2013.01); *D03D 3/04* (2013.01); *D03D 11/00* (2013.01);
(Continued)

(58) Field of Classification Search
CPC .... D21F 1/0036; D21F 1/0027; D21F 1/0045; D21F 1/0054; D21F 1/10; D21F 1/105;
(Continued)

(56) References Cited

U.S. PATENT DOCUMENTS 4,636,426 A * 1/1987 Fleischer ..... D21F 1/0027 139/383 A
5,346,590 A 9/1994 Jaala
(Continued)

FOREIGN PATENT DOCUMENTS

CN 1132291 A 10/1996
CN 1491304 A 4/2004
(Continued)

OTHER PUBLICATIONS

International Search Report (Form PCT/ISA/210) dated Jan. 21, 2016, by the State Intellectual Property Office of People's Republic of China in corresponding International Application No. PCT/CN2015/093035 and English Translation. (9 pages).

*Primary Examiner* — Eric Hug
(74) *Attorney, Agent, or Firm* — Buchanan Ingersoll & Rooney PC

(57) ABSTRACT

An industrial fabric is a web woven from warp yarns made of monofilaments and weft yarns made of monofilaments. The warp yarns are of a double-layer structure. One of warp yarn basic units comprises four sub-units, two sub-units being located on an upper layer, the other two sub-units being located on a lower layer. The warp yarns on the upper layer and the warp yarns on the lower layer are vertically overlapped, wherein at least two sub-units comprise two parallel narrow warp yarns. Upper warp yarns and lower warp yarns are identical in texture structure, or one surface is identical to the other surface after rotating by 180 degrees. The industrial fabric is stable in structure and good in overall
(Continued)

consistency. The upper surface is good in flatness, the surface is free from defects, and the quality and intensity of the fabric are improved.

18 Claims, 14 Drawing Sheets

(51) Int. Cl.

| | |
|---|---|
| ***D21F 7/12*** | (2006.01) |
| ***D03D 1/00*** | (2006.01) |
| ***D03D 11/00*** | (2006.01) |
| ***D03D 3/04*** | (2006.01) |
| ***D03D 13/00*** | (2006.01) |
| ***D21F 7/10*** | (2006.01) |

(52) U.S. Cl.
CPC ..... *D03D 13/00* (2013.01); *D21F 1/0036* (2013.01); *D21F 7/083* (2013.01); *D21F 7/10* (2013.01); *D21F 7/12* (2013.01); *D03D 2700/0162* (2013.01); *D10B 2331/04* (2013.01); *D10B 2505/00* (2013.01)

(58) Field of Classification Search
CPC ... D21F 1/12; D21F 7/08; D21F 7/083; D21F 7/10; D21F 7/12; D03D 1/00; D03D 3/04; D03D 1/0094; D03D 11/00; D03D 13/00; D03D 25/00; D03D 2700/0111; D03D 2700/0114; D03D 2700/0155; D03D 2700/0159; D03D 2700/0162
USPC ..... 139/383 A, 383 AA, 425; 162/348, 900, 162/902–904
See application file for complete search history.

(56) References Cited

U.S. PATENT DOCUMENTS

| | | | | |
|---|---|---|---|---|
| 5,465,764 | A * | 11/1995 | Eschmann | D21F 1/0027 139/383 A |
| 5,503,196 | A | 4/1996 | Josef et al. | |
| 5,799,708 | A * | 9/1998 | Josef | D21F 1/0027 139/383 A |
| 6,077,397 | A * | 6/2000 | Shipley | D21F 1/0036 162/358.1 |
| 2004/0094223 | A1 | 5/2004 | Johnson et al. | |

FOREIGN PATENT DOCUMENTS

| | | | |
|---|---|---|---|
| CN | 201520922 | U | 7/2010 |
| CN | 104818642 | A | 8/2015 |
| CN | 204825496 | U | 12/2015 |
| EP | 0 532 510 | B1 | 11/1994 |
| FI | 89819 | B | 8/1993 |

* cited by examiner

INDUSTRIAL FABRIC

CROSS REFERENCE TO RELATED APPLICATIONS

This is a continuation of International Application PCT/CN2015/093035, with an international filing date of Oct. 28, 2015, which International Application claims priorities from Patent Application No. 201510265257.4 filed in The People's Republic of China on May 22, 2015.

TECHNICAL FIELD

The present application relates to the technical field of engineering textiles.

BACKGROUND

The main process flow of paper manufacturing comprises paper forming, pressing (including wiping, vacuum and dehydration) and drying. In the drying process, wet paper sheet is sandwiched between the dryer web and the drying cylinder, the wet paper on the surface of the drying cylinder is exerted a certain amount of pressure by the dryer web, the fibers in the wet paper layer form a larger contact area with the surface of the drying cylinder under the pressure of the dryer web, and under the action of the high temperature and pressure of the surface of drying cylinder, the moisture in wet paper sheet is rapidly evaporated to reach the purpose of page drying. With the development of papermaking technology, paper machine manufacturers have successfully invented the shoe-type press technology. This technology can successfully expand the press area of paper machine to 20 times the original, the pressure area can reach more than 100 mm, the paper machine speed can reach 3,000 m/min, while the speed of the paper machine is improved, the requirement of the manufacturing technology of the dryer web is also improved correspondingly.

When the paper machine runs at a high speed, that is, when the machine runs at a speed over 800/minute, any defect on the surface of the dryer web will have an impact on the paper sheet, resulting even rupture of the paper sheet and stopping the machine. Especially in single-hung or single-row dryer parts of the first group and the second group in the paper machine, where the moisture of the wet paper layer is larger and the paper sheet is extremely easy to break. The existing dryer webs are single-layer fabrics that often run off an upper surface due to a yarn ends, resulting in the waste of tons of paper and significant waste.

In addition, because of the unreasonable structure, sometimes the tension of the web edge and the tension of the web body are often inconsistent. When the tension is too loose or too tight, the normal operation of the paper machine and the drying effect of the paper sheet will be affected, and even the edge of the paper will be damaged or broken, leading to premature disembarkation of the dryer web, seriously affecting the production and resulting in economic losses. The existing structure of dryer webs for paper manufacturing, some have only one layer, some have two layers, but since the upper and lower layer of the structure are different and have no complementarity, the overall structure is of poor consistency, the structural stability is poor, at the same time, it is very easy to produce stress concentration, so as to break or destroy the surface quality of paper.

Moreover, in the process of paper drying, the paper must be kept flat, but the dryer section of the paper machine requires that dry web must have terminal seams, some of the seams are not smooth, resulting in seam traces, as well as a "seersucker" and other convex and uneven paper disease. In the installation process, if the tension consistency of the seam loops is poor, which can also cause the crease of the dry web and affect the quality of papermaking. The air permeability of the dry web seam is too large or too small, which will also lead to paper breakage in high speed operation and affect papermaking efficiency of the paper machine.

At present, the common designs of the dry webs in the market are divided into two categories. The first category is that the warp yarn system is in an upper and lower penetrating direction and interlace with the weft yarn system to form a woven texture; the second category is that the warp yarn system is an upper and lower of the tape yarn design, warp yarn system of the upper flat yarns interlace with the weft yarn system on the upper layer; warp yarn system of the lower flat yarns interlace with the weft yarn system on the lower layer.

In the dryer web seam, whether it is the pin loop seam or the spiral loop seam, all the warp yarns after being return-plugged form a 4-row butted breakpoints in the cross direction (CD) on the back of the dryer web. The yarn ends of these butted breakpoints, as the damaged paper sheet will be wrapped around the drying cylinder or guide roller in the operational process of dryer web, resulting in an excessive local stress and that dryer web will be over-stretched. The butted breakpoints on the back of the part of the over-stretched dryer web will return to the front of the dryer web, resulting the paper sheets to be scratched and forming holes in the surface of the paper sheets. In the paper-making market in Korea, some papermakers once returned the purchased dryer webs due to such defects on paper sheets, which causes huge losses to paper providers and dryer web providers.

All these kinds of things happen frequently in the existing technology, people are trying to find solutions, but they have never been completely solved, which has seriously affected the quality of paper making and the improvement of efficiency. As the rejection rate is high, the production cost is greatly increased.

SUMMARY OF THE INVENTION

The main technical problem solved by the present application is to provide an industrial fabric for the problems existing in the prior art. Through the improvement of the structure of the industrial fabric, the industrial fabric has the advantages of stable structure and good overall consistency, does not deform easily, and is durable, and improves the quality and the strength of the fabric, such that the quality and efficiency of paper making are guaranteed, the rejection rate is reduced, and the cost is greatly reduced. The industrial fabric is especially suitable for the papermaking dryer web, can also serve as a conveyor belt, and is widely applied to the industries such as paper making, chemical engineering, medicine and machinery.

The technical scheme of the application is as follows: an industrial fabric which is a web woven from warp yarns made of monofilaments and weft yarns made of monofilaments, wherein, the structure or texture of the warp yarns are of a double-layer structure, i.e., an upper layer in which upper layer warp yarns interlace with the weft yarns, and a lower layer in which lower layer warp yarns interlace with the weft yarns, wherein the upper layer warp yarns do not intersect with the lower layer warp yarns; one of warp yarn basic units comprises four sub-units, wherein two sub-units being located on the upper layer, the other two sub-units being located on the lower layer, the warp yarns on the upper layer and the warp yarns on the lower layer are vertically overlapped, wherein at least two sub-units comprise two parallel narrow warp yarns; and wherein the warp yarns have flat cross-sections respectively;

upper warp yarns and lower warp yarns, namely front warp yarns and back warp yarns, are identical in texture structure, or one surface is identical to the other surface after rotating by 180 degrees.

Preferably, the web is of a web with ends.

Preferably, the seam structure of the web with ends is a pin loop seam or a spiral loop seam.

Preferably, the cross-section of the warp yarns is rectangular.

Preferably, the double-layer structure is that: one sub-unit of upper warp yarns has two parallel narrow warp yarns and the other sub-unit also has two parallel narrow warp yarns; one sub-unit of lower warp yarns has two parallel narrow warp yarns and the other sub-unit also has two parallel narrow warp yarns; two narrow warp yarns of the upper sub-unit and two narrow warp yarns of the lower sub-unit are vertically overlapped.

Preferably, the double-layer structure is that one sub-unit of upper warp yarns has one wide warp yarn and the other sub-unit has two narrow warp yarns; one sub-unit of lower warp yarns has two narrow warp yarns and the other sub-unit has one wide warp yarn; one wide warp yarn on the upper layer and two narrow warp yarns on the lower layer are vertically overlapped, the width of the wide warp yarn is 0.6-1.5 times the sum of the widths of the two narrow warp yarns; two narrow warp yarns on the upper layer and one wide warp yarn on the lower layer are vertically overlapped, the width of the wide warp yarn is 0.6-1.5 times the sum of the widths of the two narrow warp yarns.

Preferably, the double-layer structure is that one sub-unit of upper warp yarns has one wide warp yarn and the other sub-unit has two narrow warp yarns; one sub-unit of lower warp yarns has two narrow warp yarns and the other sub-unit has one wide warp yarn; one wide warp yarn on the upper layer and one wide warp yarn on the lower layer are vertically overlapped; two parallel narrow warp yarns on the upper layer and two parallel narrow warp yarns on the lower layer are vertically overlapped.

Preferably, the double-layer structure is that the cross-section of the web has the following arrangement sequence: upper warp yarns in warp yarn sub-units have two wide warp yarns and four narrow warp yarns, the corresponding lower warp yarns have four narrow warp yarns and two wide warp yarns; or upper warp yarns have three wide warp yarns and six narrow warp yarns, the corresponding lower warp yarns have six narrow warp yarns and three wide warp yarns.

Preferably, the cross-section of weft yarns is circular or rectangular, of which the diameters or thicknesses are the same or different to each other.

The monofilaments are made of polymeric resins.

Preferably, the polymeric resins comprise one or more of polyester monofilaments, PPS monofilaments, PEEK, PCTA and nylon monofilaments.

The positive effect of the application is that: compared with the prior art, the problem existing in the prior art is well solved. Through the improvement of the structure of the industrial fabric, the industrial fabric has the advantages of stable structure and good overall consistency, does not deform easily, and is durable. The upper surface is good in flatness, the surface is free from defects, and the quality and intensity of the fabric are improved, such that the quality and efficiency of paper making are guaranteed, the rejection rate is reduced, and the cost is greatly reduced.

With the reasonable configuration of warp yarn units, the present application ensures that front warp yarns and back warp yarns are identical in texture structure, or one surface is identical to the other surface after rotating by 180 degrees. Compared with the traditional design with different back and front textures, the present application can effectively eliminate the stress difference caused by the difference of the front and back textures, improve the consistency of the web texture remarkably, and obtain the smoother and flatter surface of the web.

With the use of independent upper and lower structure, the upper and lower warp yarns will never intersect with each other, and the plugging connector will always remain on the machine surface without penetrating the web body to the sticker surface and damaging the page sheets. The introduction of parallel double warp yarn units, compared with a single wide warp yarn, the parallel double narrow warp yarns with the same total width, which can provide more warp and weft interweave points and effectively improve the latitudinal stability of the web. The flexible plug-in scheme or combination can be obtained, at the same time, the additional filling-yarns in the seam loops can be added to reduce the gap in the seam area and avoid the occurrence of paper prints while ensuring the convenience of accessing to the web.

The present application is especially suitable for the paper making dryer web, can also serve as a conveyor belt, and is widely applied to the industries such as paper making, chemical engineering, medicine and machinery.

The following embodiments are described in detail with reference to the accompanying drawings, but are not intended to limit the present application.

Figure 1:
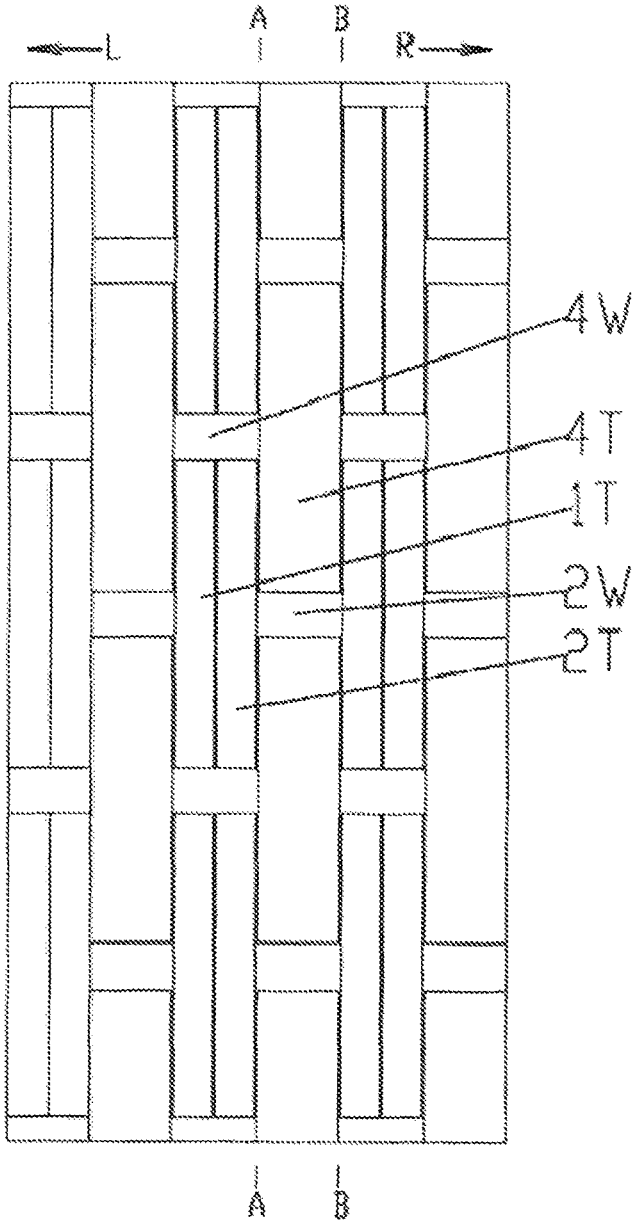
FIG. 1 is a schematic structural view of a first embodiment of the present application (a front of the web).

In order to describe clearly, the same numbers or letter numbers are used for the same elements in the figures. The L and R with arrows in the figure represent the left and right sides of the fabric, respectively, only for the convenience of the reader to identify the corresponding relationship in the figures.

DETAILED DESCRIPTION OF THE EMBODIMENTS

The dryer web described in the present application is a double-layer structure with warp yarns texture, i.e., an upper layer in which upper layer warp yarns interlace with the weft yarns, and a lower layer in which lower layer warp yarns interlace with the weft yarns, and the upper layer warp yarns do not intersect with the lower layer warp yarns. The warp yarns in all warp yarn textures have noncircular or generally rectangular cross-sections. The cross-section of weft yarns can be circular or rectangular or any other shape. Weft yarns of different sizes can be applied to the present fabric at the same time.

The dryer web fabric in the present application is made of monofilaments and woven according to the designed texture structure. In the design of dryer web fabrics, different synthetic polymer resin monofilaments are selected according to different paper machines, different paper types and the special needs of different users. Commonly used monofilaments include polyester monofilaments and PPS monofilaments, other materials include polymers such as PEEK, PCTA, nylon and the like. Two or more different types of monofilament can be selected for warp yarns, and two or more different types of monofilament can also be selected for weft yarns.

The front and the back texture of the present application are exactly the same, or the front texture is identical to the back texture after being rotated by 180 degrees, so that both the front side and the back side can be used as the sticker surface.

Embodiment 1

The double-layer structure is that one sub-unit of upper warp yarns has one wide warp yarn and the other sub-unit has two narrow warp yarns; one sub-unit of lower warp yarns has two narrow warp yarns and the other sub-unit has one wide warp yarn; one wide warp yarn on the upper layer and two narrow warp yarns on the lower layer are vertically overlapped, the width of the wide warp yarn is 0.6-1.5 times the sum of the widths of the two narrow warp yarns; two narrow warp yarns on the upper layer and one wide warp yarn on the lower layer are vertically overlapped, the width of the wide warp yarn is 0.6-1.5 times the sum of the widths of the two narrow warp yarns.

That is, one sub-unit of upper warp yarns is a wide warp yarn 4*t* with a rectangular cross-section, the other sub-unit is two parallel narrow warp yarns 1*t*, 2*t* with a rectangular cross-section; one sub-unit of lower warp yarns is two parallel narrow warp yarns 5*b*, 6*b* with a rectangular cross-section, the other sub-unit is a wide warp yarn 3*b* with a rectangular cross-section. The four warp yarn sub-units are woven in accordance with the texture diagram in Table 2 to form dryer web fabrics and are alternately arranged in the entire web.

Figure 2:
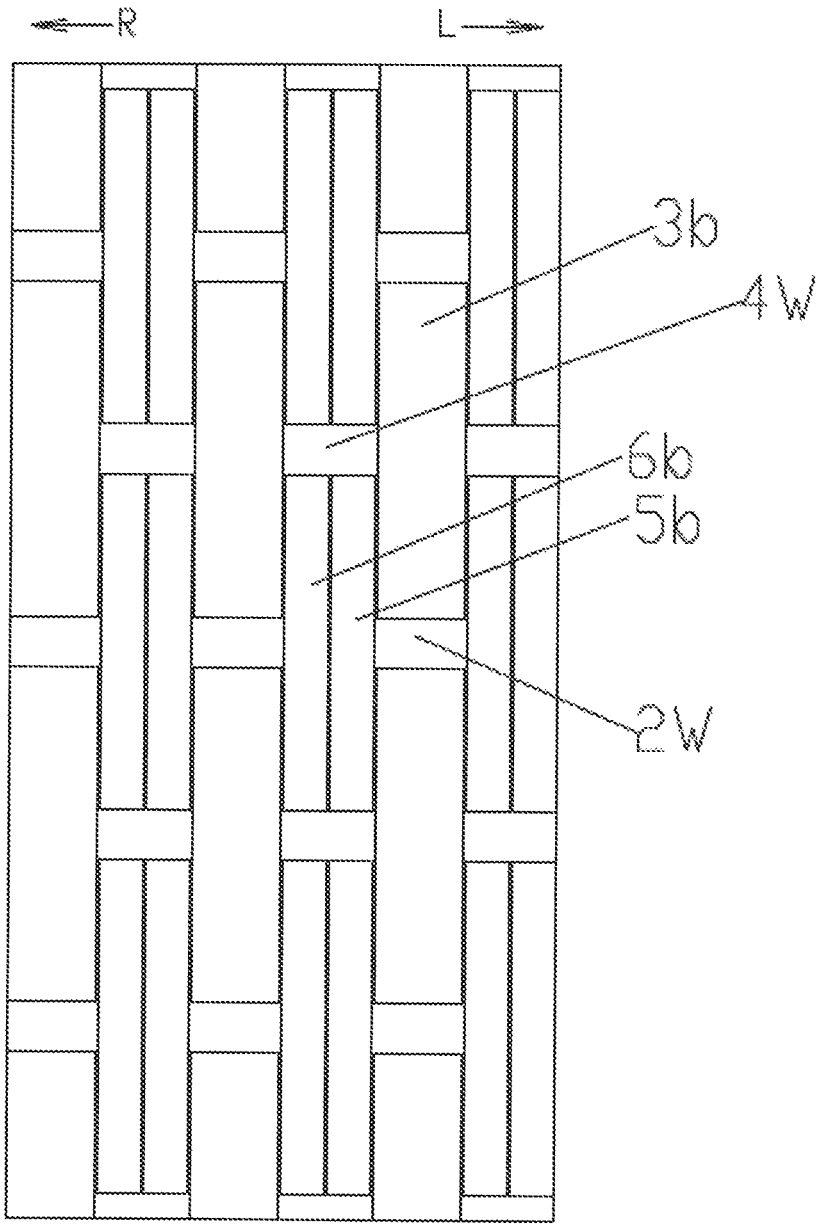
FIG. 2 is a rear view of FIG. 1 (a back of the web).

FIG. 1 and FIG. 2 are 3D views of the front and back of the dryer web fabrics in Table 1. As shown in the 3D views, the sum of the widths of the two front narrow warp yarns 1*t* and 2*t* is substantially equal to the width of the back wide warp 3*b*; similarly, the width of the front wide warp 4*t* is approximately equal to the sum of the widths of the back warps 5*b* and 6*b*. For example, the cross-sectional dimensions of 1*t*, 2*t* are 0.36 mm×0.53 mm (thickness×width), and the cross-sectional dimensions of 3*b* or 4*t* is 0.36 mm×1.06 mm (thickness×width) respectively.

It can also be seen from FIG. 1 and FIG. 2 that the front texture of the dryer web is exactly the same as the back texture of the dryer web after being rotated by 180 degrees. Compared with the traditional design with different back and front textures, the present application can effectively eliminate the stress difference caused by the difference of the front and back textures, improve the consistency of the web texture remarkably, and obtain the smoother and flatter surface of the web. The backs of the warp yarns 1*t*, 2*t*, and 4*t* in the white frame of FIG. 1 are the warp yarns 3*b*, 5*b*, and 6*b* in the white frame of FIG. 2; similarly, the weft yarns 2*w* and 4*w* can also be seen.

TABLE 1

Texture diagram of the first embodiment

| | 1t | 2t | 3b | 4t | 5b | 6b |
|---|---|---|---|---|---|---|
| 4w | | | | x | x | x |
| 3w | x | x | | x | | |
| 2w | x | x | x | | | |
| 1w | x | x | | x | | |

| Weft Yarns | Yarn Diameter |
|---|---|
| 4w | Diameter: 0.40-0.70 mm |
| 3w | Diameter: 0.70-1.00 mm |
| 2w | Diameter: 0.40-0.70 mm |
| 1w | Diameter: 0.70-1.00 mm |

| | Warp Yarns | | | | | |
|---|---|---|---|---|---|---|
| | 1t | 2t | 3b | 4t | 5b | 6b |
| | Upper layer | | Lower layer | Upper layer | Lower layer | |
| Yarn Diameter | Thickness (mm): 0.25-0.50 Width (mm): 0.40-0.80 | | Thickness (mm): 0.25-0.50 Width (mm): 0.80-1.60 | | Thickness (mm): 0.25-0.50 Width (mm): 0.40-0.80 | |

Figure 3:
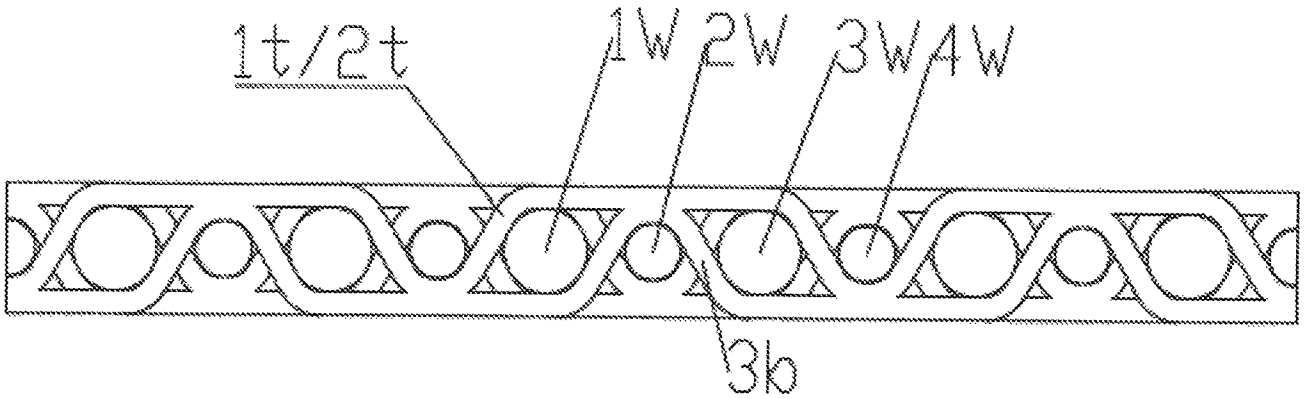
FIG. 3 is a cross-sectional view along the line A-A in FIG. 1.

FIG. 3 is a cross-sectional view along the line A-A of the dryer web in FIG. 1. This 3D view shows only the texture structure of warp yarns 1*t*, 2*t*, 3*b* and weft yarns 1*w*, 2*w*, 3*w*, 4*w*. It can be clearly seen from the figure that the diameters of 1*w* and 3*w* are thicker and the diameters of 2*w* and 4*w* are smaller. The upper warp yarn sub-units 1*t* and 2*t* are oriented in three upward and one downward, that is, three of them are above the weft yarns 1*w*, 2*w*, 3*w* and the other is below the weft yarn 4*w*. The lower warp yarn sub-unit 3*b* are wide yarns, which are oriented in one downward, one upward and two downward, that is, one of them is below the weft yarn 1*w*, one of them is above the weft yarn 2*w* and the other two are below the weft yarns 3*w*, 4*w*. The aforementioned warp and weft yarns cycle back and forth to form a first group of warp and weft yarn texture structure.

Figure 4:
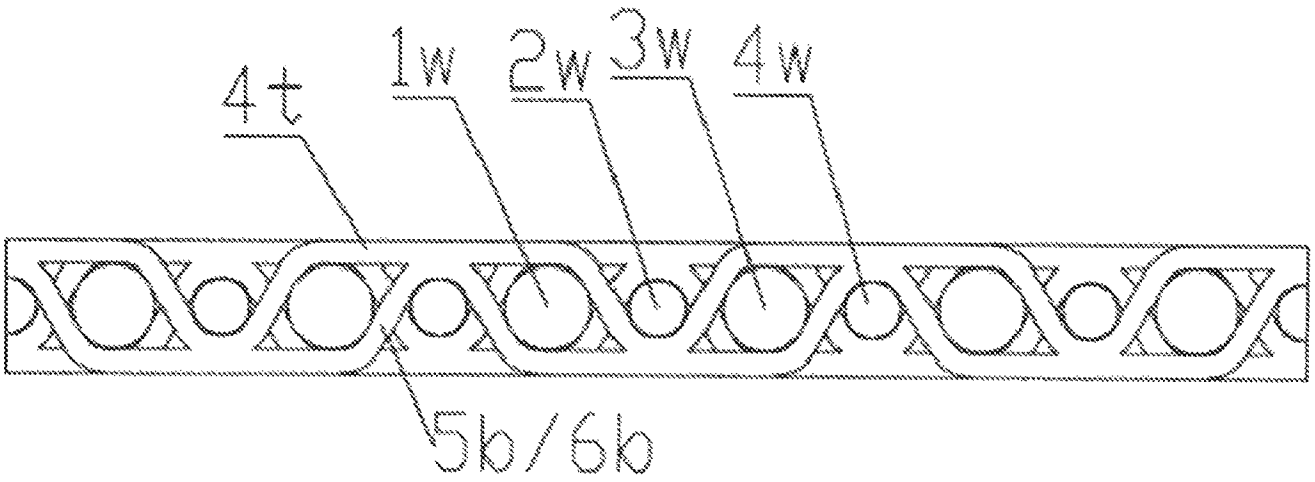
FIG. 4 is a cross-sectional view along the line B-B in FIG. 1.

FIG. 4 is a cross-sectional view along the line B-B of the dryer web in FIG. 1. This 3D view shows only the texture structure between warp yarns 4*t*, 5*b*, 6*b* and weft yarns 1*w*, 2*w*, 3*w*, 4*w*. Similarly, it can be seen from the figure that the diameters of 1*w* and 3*w* are thicker and the diameters of 2*w* and 4*w* are smaller. The upper warp yarn sub-unit 4*t* are oriented in one upward, one downward and two upward, that is, one of them is above the weft yarn 1*w*, one of them is below the weft yarn 2*w* and the other two are above the weft yarns 3*w*, 4*w*; the lower warp yarn sub-units 5*b* and 6*b* are oriented in three downward and one upward, that is, three of them are below the weft yarns 1*w*, 2*w* and 3*w* and the other is above the weft yarn 4*w*. The aforementioned warp and weft yarns cycle back to form a second kind of warp and weft texture structure and form a complete weave texture together with the first group of texture structure, which penetrates all the web bodies of the dryer web.

Figure 5:
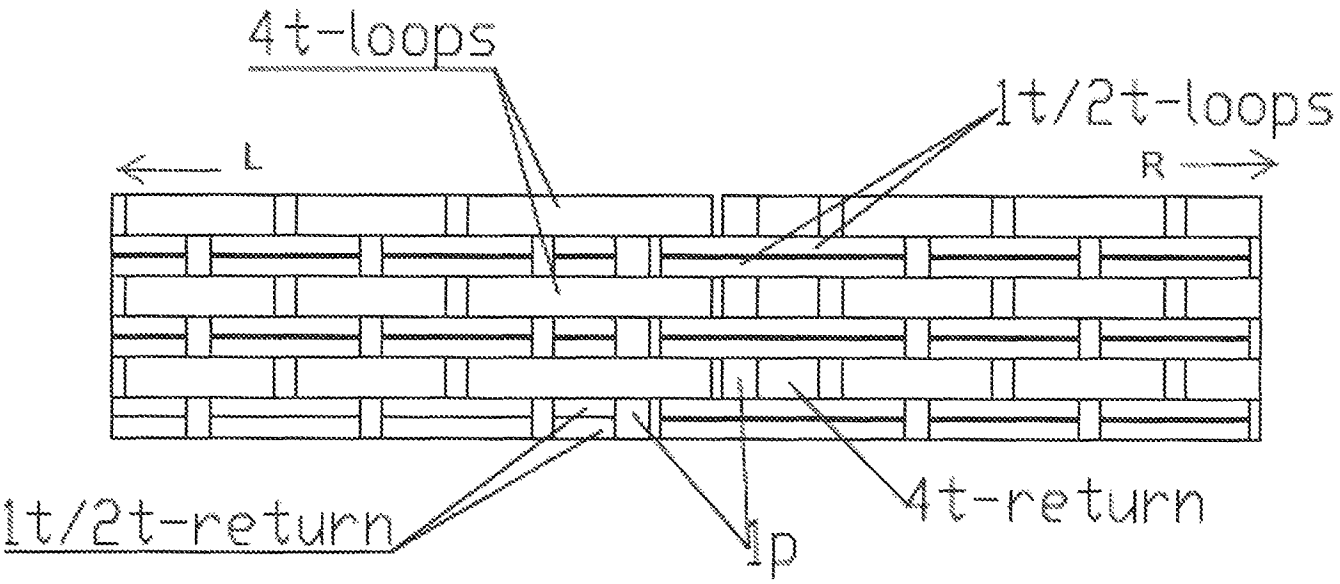
FIG. 5 is a schematic structural view at the seam of an embodiment 1.

FIG. 5 shows the 3D front view of the dryer web seam. As shown in the figure, when the 4*t* in the warp yarns is return-plugged on the left side of the dryer web, leaving a sufficient length of warp yarns as seam loops for return-plugging and forming the seam loops (i.e. 4*t*-loops) at the left side of the dryer web end; similarly, when 1*t* and 2*t* in the warp yarns are return-plugged together, leaving a sufficient length of warp yarns for return-plugging and forming return-loops (i.e. 1*t*/2*t*-loops) at the right side of the dryer web end. When warp yarns 1*t* and 2*t* are return-plugged at the left side of the dryer web, they must be return-plugged in tight against the weft yarn 3*w* and form return-loops (i.e. 1*t*/2*t*-return) and leave empty spaces for the seam loops of the warp yarns 1*t*, 2*t* at the right side of the dryer web; similarly, when the warp yarn 4*t* at the right side of the dryer web is return-plugged, it must be return-plugged in tight against the weft yarn 1*w* and form return-loops (i.e. 4*t*-return) and leave empty spaces for the seam loops of the warp yarn 4*t* at the left side of the dryer web.

Figure 6:
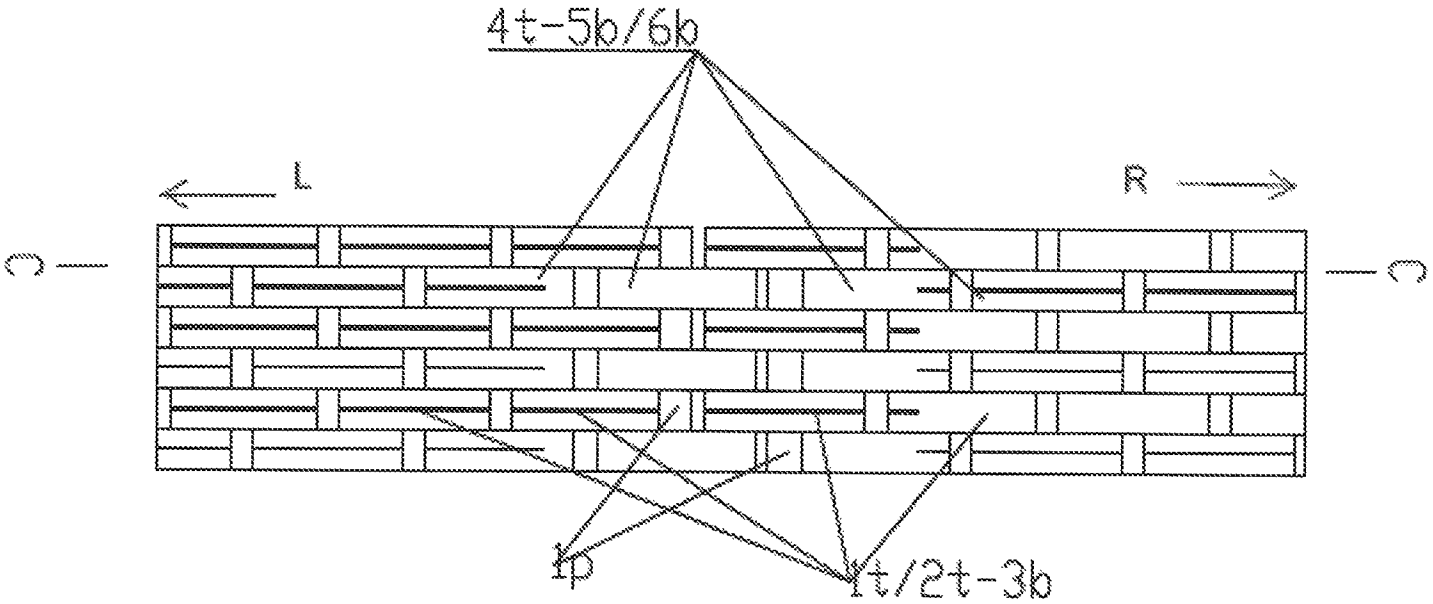
FIG. 6 is a rear view of FIG. 5.

FIG. 6 is a 3D rear view of the dryer web seam. As shown in the figure, the warp yarns 1*t*, 2*t* at the left side of the dryer web, which are abutted against the weft yarn 3*w* and into abutment with the warp yarn 3*b*; the warp yarn 4*t* forms a seam loop and comes into abutment with the warp yarns 5*b*, 6*b*; the warp yarns 1*t*, 2*t* at the right side of the dryer web form seam loops and are return-plugged into abutment with the warp yarn 3*b*, the warp yarn 4*t* abutted against the weft yarn 1*w* is return-plugged into abutment with the warp yarns 5*b*, 6*b*. All the return-plugged warp yarns must be bent and return-plugged according to the dryer web texture structure by the warp yarns formed during the processing, the seam area of the return-plugged parts is consistent with the texture structure of the dryer web except the butted breakpoints. As the upper and lower structures are independent of each other, the upper and lower warp yarns will never intersect with each other, and the plugging connector will always remain on the machine surface without penetrating the web body to the sticker surface and damaging the page sheets.

Figure 7:
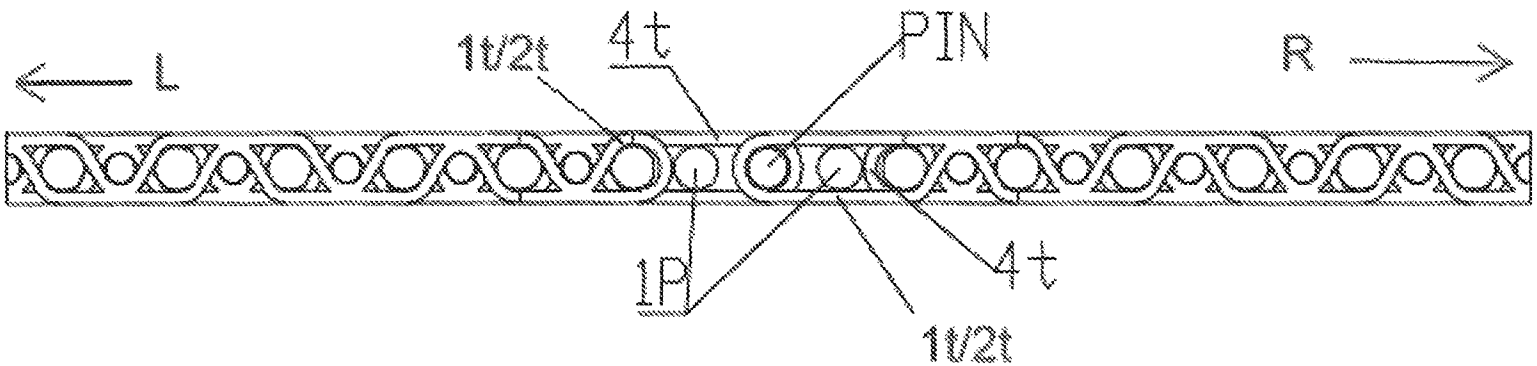
FIG. 7 is a cross-sectional view along the line C-C in FIG. 6.

FIG. 7 is a cross-sectional view along the line C-C of the dryer web seam of FIG. 6. The seam loops at the left and right sides come into meshing abutment with each other and then are connected by one or more threading-yarns (the PIN in the figure), such that the dryer web forms a closed loop. At the same time, filling the seam loops with two filling-yarns 1*p* of suitable size, which can effectively reduce the gap in the seam area and avoid the occurrence of paper prints while ensuring the convenience of accessing to the web. Since the flexibility of this kind of textured structure, the seam is not limited to the types shown in FIG. 6 and FIG. 7, and two narrow warp yarns can be selected from the left side as the seam loop and two narrow warp yarns can also be selected from the right side as the seam loop; or one wide warp yarn can be selected from left side as the seam loop, and one wide warp yarn can be selected from right side as the seam loop. When the left and right sides are using narrow yarns as the seam loops, it can also make spiral loop seam.

Embodiment 2

The double-layer structure is that: one sub-unit of upper warp yarns has two parallel narrow warp yarns and the other sub-unit also has two parallel narrow warp yarns; one sub-unit of lower warp yarns has two parallel narrow warp yarns and the other sub-unit also has two parallel narrow warp yarns; two parallel narrow warp yarns of the upper sub-unit and two parallel narrow warp yarns of the lower sub-unit are vertically overlapped.

That is, one sub-unit of upper warp yarns is two parallel warp yarns 11*t*, 12*t* with a rectangular cross-section, the other sub-unit is two parallel narrow warp yarns 13*t* and 14*t* with a rectangular cross-section; one sub-unit of lower warp yarns is two parallel narrow warp yarns 15*b*, 16*b* with a rectangular cross-section, the other sub-unit is two parallel narrow warp yarns 17*b*, 18*b* with a rectangular cross-section. The warp yarns in the 4 sub-units are woven in accordance with the texture diagram in Table 1 to form dryer web fabrics and are alternately arranged in the entire web.

Figure 8:
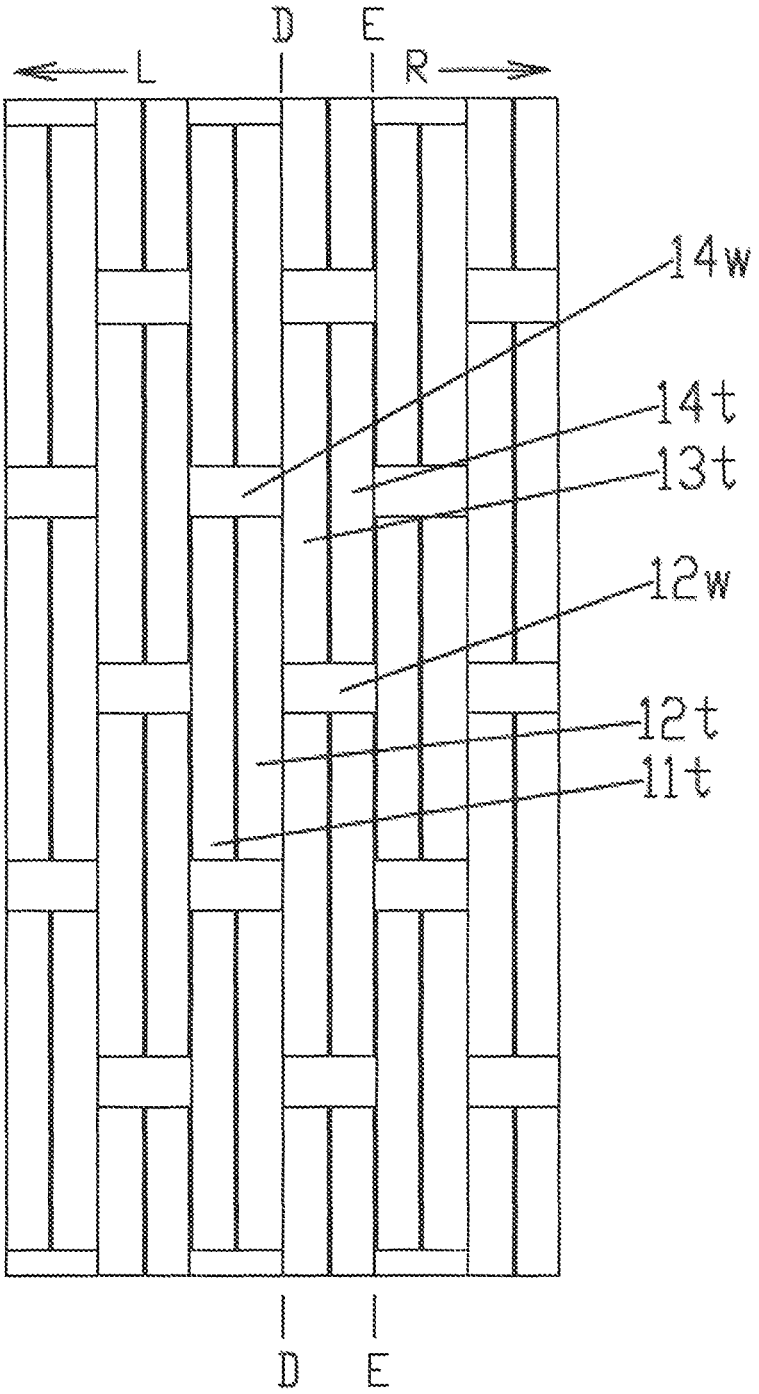
FIG. 8 is a schematic structural view of an embodiment 2 of the present application (front of the web).
Figure 9:
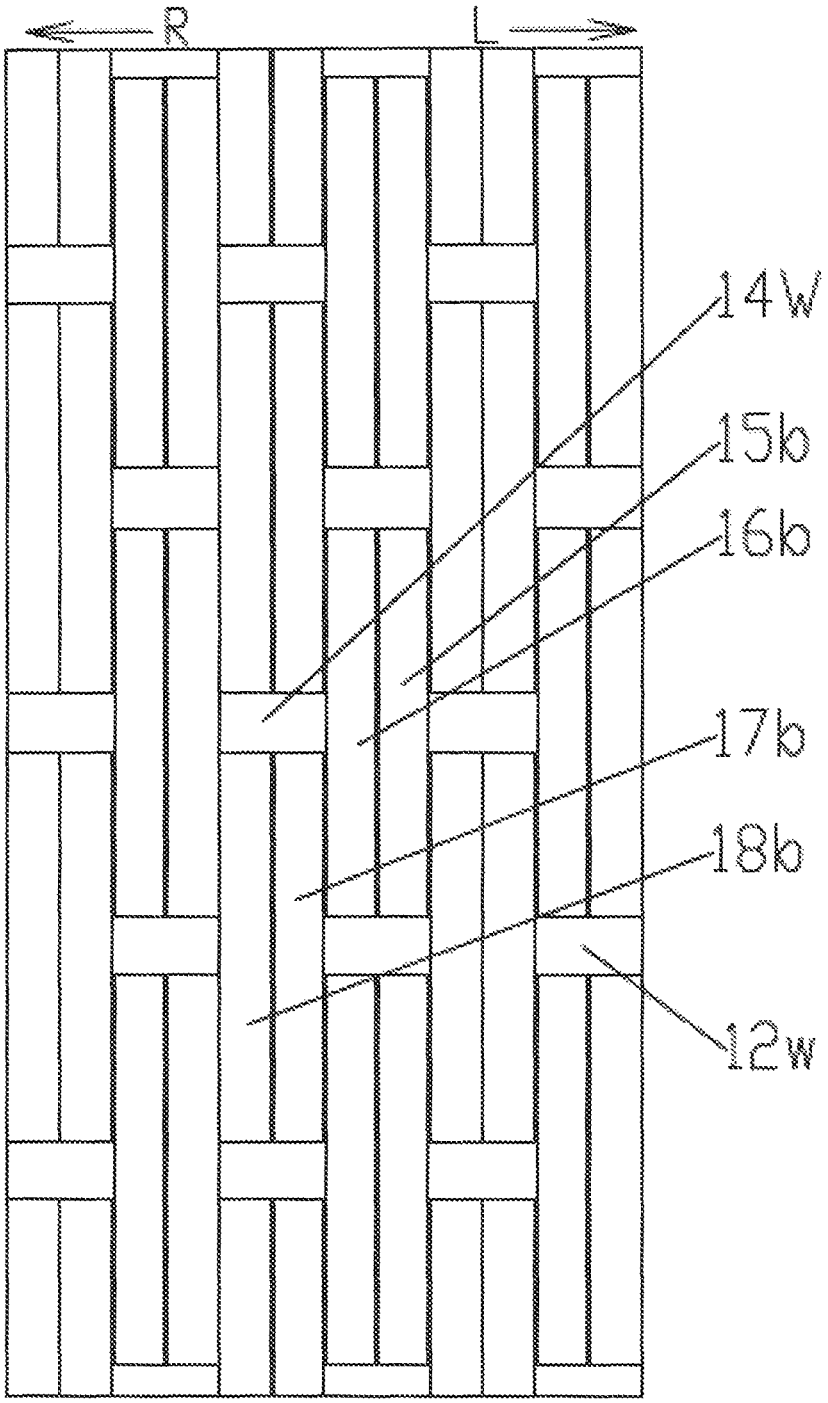
FIG. 9 is a rear view of FIG. 8 (a back of the web).

FIG. 8 and FIG. 9 are 3D views of the front and back of the dryer web fabrics in Table 2. As shown in the 3D views, the widths of the warp yarns in the upper warp yarn sub-unit are substantially equal to the widths of the warp yarns in the lower warp yarn sub-unit, and the warp yarn widths in different warp yarn sub-units in each layer are also substantially the same. For example, the cross-sectional dimensions of 11*t*, 12*t* are 0.36 mm×0.53 mm, the cross-sectional dimensions of 13*t* or 14*t* are 0.36 mm×0.53 mm, the cross-sectional dimensions of 15*b* or 16*b* is 0.36 mm×0.53 mm, and the cross-sectional dimensions of 17*b* and 18*b* are 0.36 mm×0.53 mm.

It can also be seen from FIG. 8 and FIG. 9 that the front texture of the dryer web is exactly the same as the back texture of the dryer web. Compared with the traditional design with different back and front textures, the present application can effectively eliminate the stress difference caused by the difference of the front and back textures, improve the consistency of the web texture remarkably, and obtain the smoother and flatter surface of the web. The backs of the warp yarns 11*t*, 12*t*, 13*t* and 14*t* in the white frame of FIG. 8 are the warp yarns 15*b*, 16*b*, 17*b* and 18*b* in the white frame of FIG. 9; similarly, the weft yarns 2*w* and 4*w* can also be seen accordingly.

Figure 10:
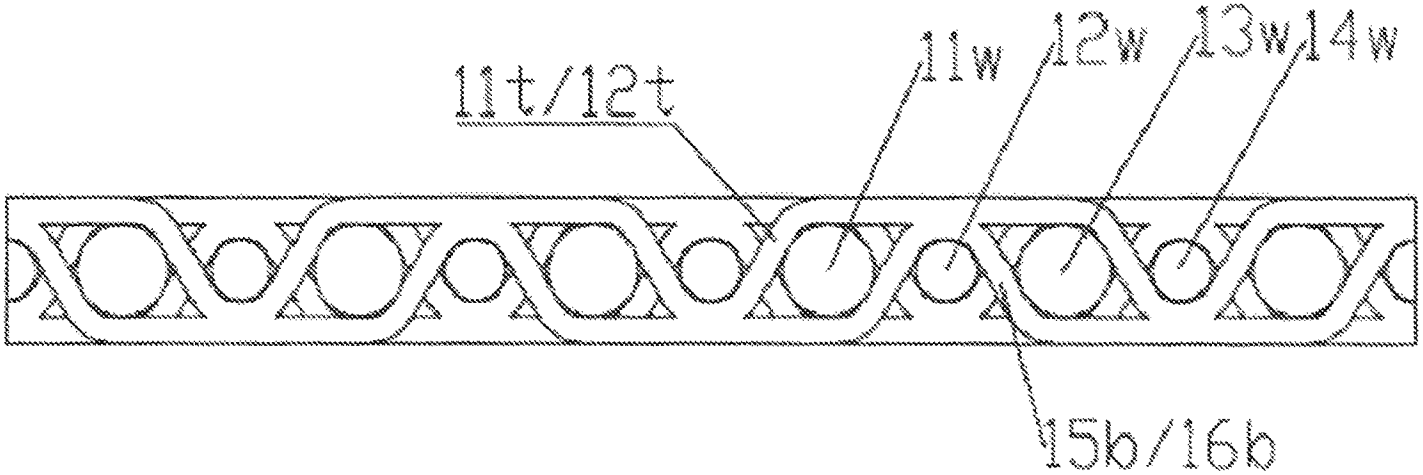
FIG. 10 is a cross-sectional view along the line D-D in FIG. 8.

FIG. 10 is a cross-sectional view along the line D-D of the dryer web in FIG. 8. This 3D view shows only the texture structure of warp yarns 11*t*, 12*t*, 15*b*, 16*b* and weft yarns 11*w*, 12*w*, 13*w*, 14*w*. It can be clearly seen from the figure that the diameters of 11*w* and 13*w* are thicker and the diameters of 12*w* and 14*w* are smaller. The upper warp yarn sub-units 11*t* and 12*t* are oriented in three upward and one downward, that is, three of them are above the weft yarns 11*w*, 12*w* and 13*w* and the other is below the weft yarn 14*w*. The lower warp yarn sub-units 15*b* and 16*b* are oriented in one downward, one upward and two downward, that is, one of them is below the weft yarn 11*w*, one of them is above the weft yarn 12*w* and the other two are below the weft yarns 13*w*, 14*w*. The aforementioned warp and weft yarns cycle back and forth to form a first group of warp and weft yarn texture structure.

TABLE 2

Texture diagram of the second embodiment

| | 11t | 12t | 15b | 16b | 13t | 14t | 17b | 18b |
|---|---|---|---|---|---|---|---|---|
| 14w | | | | | x | x | x | x |
| 13w | x | x | | | x | x | | |
| 12w | x | x | x | x | | | | |
| 11w | x | x | | | x | x | | |

Weft Yarns Yarn Diameter

TABLE 2-continued

| Texture diagram of the second embodiment | | | | | | | | |
|---|---|---|---|---|---|---|---|---|
| | 14w | | Diameter : 0.40-0.70 mm | | | | | |
| | 13w | | Diameter : 0.70-1.00 mm | | | | | |
| | 12w | | Diameter : 0.40-0.70 mm | | | | | |
| | 11w | | Diameter : 0.70-1.00 mm | | | | | |
| | Warp Yarns | | | | | | | |
| | 11t | 12t | 15b | 16b | 13t | 14t | 17b | 18b |
| | Upper layer | | Lower layer | | Upper layer | | Lower layer | |
| Yarn Diameter | Thickness (mm): 0.25-0.50 Width (mm): 0.40-0.80 | | Thickness (mm): 0.25-0.50 Width (mm): 0.40-0.80 | | Thickness (mm): 0.25-0.50 Width (mm): 0.40-0.80 | | Thickness (mm): 0.25-0.50 Width (mm): 0.40-0.80 | |

Figure 11:
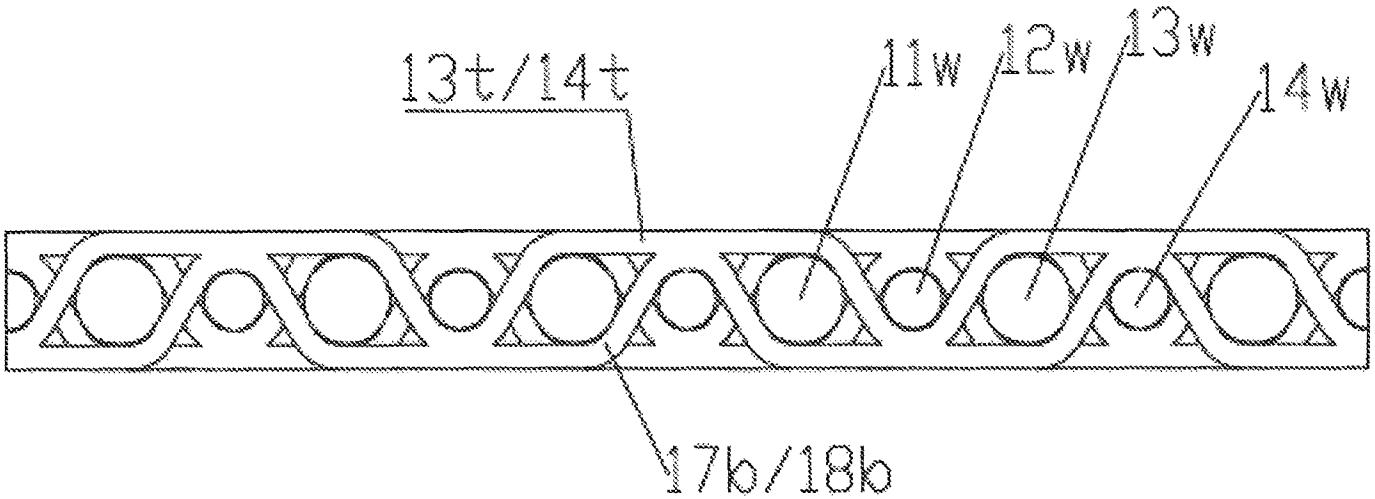
FIG. 11 is a cross-sectional view along the line E-E in FIG. 8.

FIG. 11 is a cross-sectional view along the line E-E of the dryer web in FIG. 8. This 3D view shows only the texture structure between warp yarns 13*t*, 14*t*, 17*b*, 18*b* and weft yarns 11*w*, 12*w*, 13*w*, 14*w*. Similarly, it can be seen from the figure that the diameters of 11*w*, 13*w* are thicker and the diameters of 12*w* and 14*w* are smaller. The upper warp yarn sub-units 13*t* and 14*t* are oriented in one upward, one downward and two upward, that is, one of them is above the weft yarn 11*w*, one of them is below the weft yarn 12*w* and the other two are above the weft yarns 13*w*, 14*w*; the lower warp yarn sub-units 17*b*, 18*b* are oriented in three downward and one upward, that is, three of them are below the weft yarns 11*w*, 12*w*, 13*w* and the other is above the weft yarn 14*w*. The aforementioned warp and weft yarns cycle back to form a second kind of warp and weft texture structure and form a complete weave texture together with the first group of texture structure, which penetrates all the web bodies of the dryer web.

Figure 12:
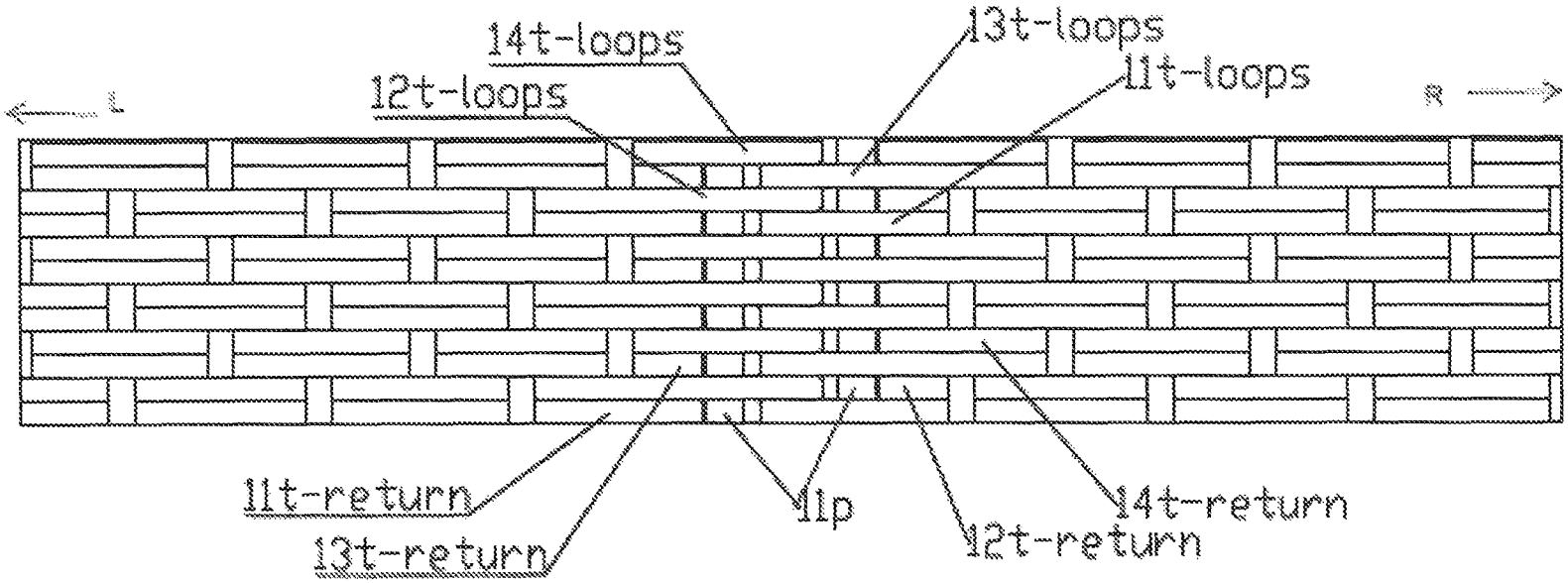
FIG. 12 is a schematic structural view at the seam of the embodiment 2.

FIG. 12 shows the 3D front view of the dryer web seam. As shown in the figure, when the warp yarns 12*t*, 14*t* on the left side are return-plugged, leaving a sufficient length of warp yarns as seam loops for return-plugging and forming the seam loops (i.e. 12*t*-loops and 14*t*-loops) at the left side of the dryer web end; similarly, when the warp yarns 11*t*, 13*t* on the right side are return-plugged together, leaving a sufficient length of warp yarns for return-plugging and forming return-loops (i.e. 11*t*-loops and 13*t*-loops) at the right side of the dryer web end. When warp yarns 11*t*, 13*t* are return-plugged at the left side of the dryer web, they are return-plugged in tight against the weft yarn 11*w* and form return-loops (i.e. 11*t*-return and 13*t*-return) and leave empty spaces for the seam loops of the warp yarns 11*t* and 13*t* at the right side of the dryer web; when the warp yarns 12*t* and 14*t* at the right side is return-plugged and in tight against the weft yarn 13*w* to form return-loops (i.e. 12*t*-return and 14*t*-return), and leave empty spaces for the seam loops formed by the warp yarns 12*t* and 14*t* at the left side. The seams are into abutment with each other by the seam loops formed on the left and right sides and the space formed adjacent to the weft yarns, and the web body is connected into a loop by threading the seam loops.

Figure 13:
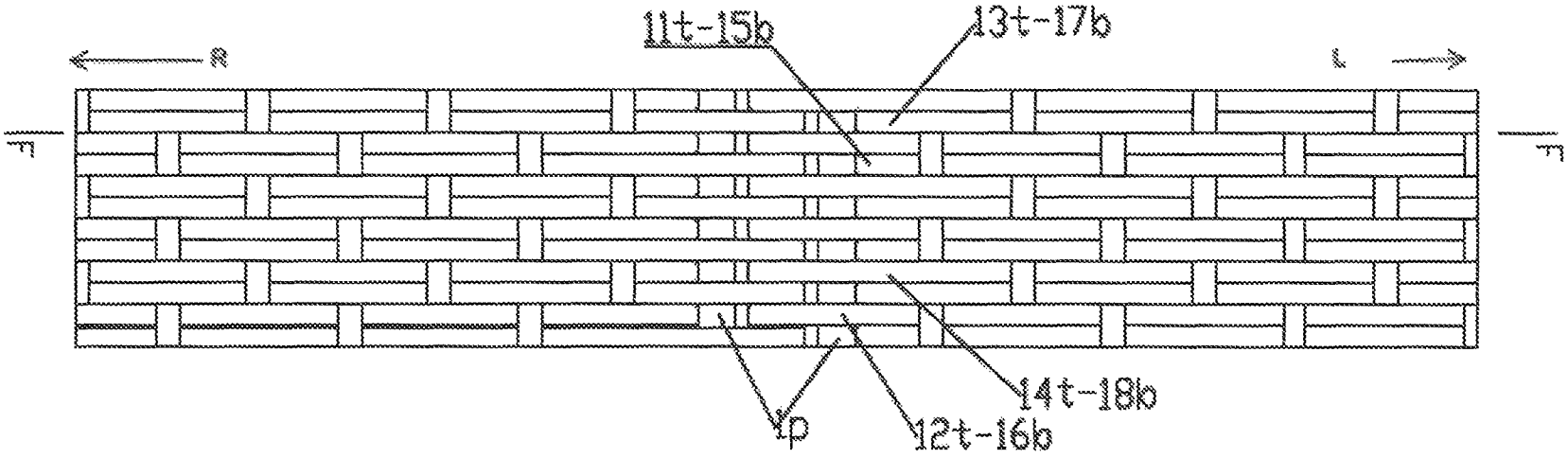
FIG. 13 is a rear view of FIG. 12.

FIG. 13 is a 3D rear view of the dryer web seam. As shown in the figure, the warp yarns 11*t* and 13*t* at the left side of the dryer web, which are abutted against the weft yarn 11*w* and into abutment with the warp yarns 15*b*, 17*b*, the warp yarns 12*t*, 14*t* form seam loops and come into abutment with the back warp yarns 16*b* and 18*b*; the warp yarns 12*t* and 14*t* at the right side of the dryer web, which are abutted against the weft yarn 13*w* and into abutment with the back warp yarns 16*b*, 18*b*, the warp yarns 11*t*, 13*t* form seam loops and come into abutment with the back warp yarns 15*b*, 17*b*. All the return-plugged warp yarns must be bent and return-plugged according to the dryer web texture structure by the warp yarns formed during the processing, the seam area of the return-plugged parts is consistent with the texture structure of the dryer web except the butted breakpoints. As the upper and lower structures are independent of each other, the upper and lower warp yarns will never intersect with each other, and the plugging connector will always remain on the machine surface without penetrating the web body to the sticker surface and damaging the page sheets.

Figure 14:
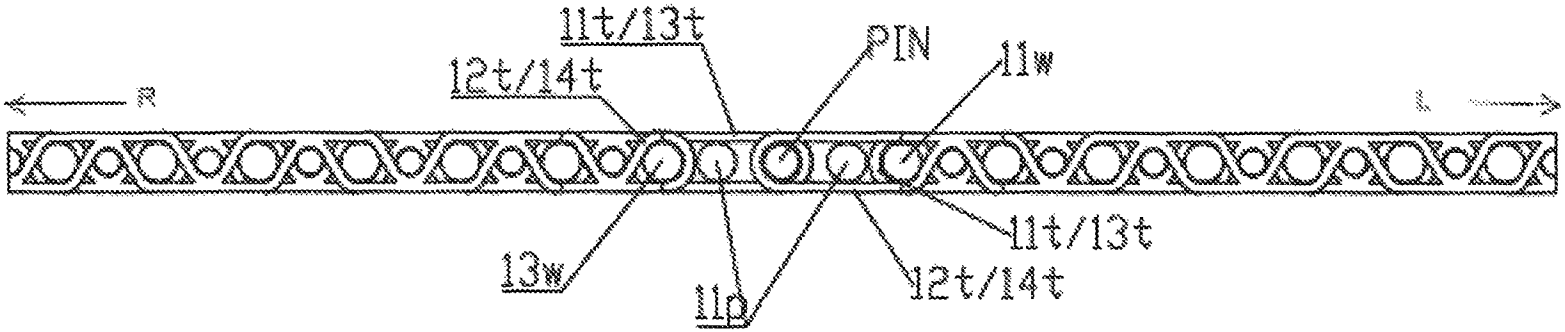
FIG. 14 is a cross-sectional view along the line F-F in FIG. 13.

FIG. 14 is a cross-sectional view along the line F-F of the dryer web seam of FIG. 7. The seam loops at the left and right sides come into meshing abutment with each other and then are connected by one or more threading-yarns (the PIN in the figure), such that the dryer web forms a closed loop. Since the complete consistency of the texture structure, either one of the upper and lower layers can be used as a seam loop, and either one of two parallel warp yarns can also be used as a seam loop. Since the widths of two parallel warp yarns are smaller, compared with the seam loops made by conventional wide yarns, the resulting seam gap is half as narrow as the gap formed by the wide warp yarns of two-width. At the same time, filling the seam loops with two filling-yarns 11*p* of suitable size, which can effectively reduce the gap in the seam area and avoid the occurrence of paper prints while ensuring the convenience of accessing to the web.

Embodiment 3

In the third embodiment of the present application, one sub-unit of upper warp yarns is a wide warp yarn with a rectangular cross-section, the other sub-unit is two parallel narrow warp yarns with a rectangular cross-section; one sub-unit of lower warp yarns is two parallel narrow warp yarns with a rectangular cross-section, the other sub-unit is a wide warp yarn with a rectangular cross-section. Wherein one wide warp yarn on the upper layer and one wide warp yarn on the lower layer are vertically overlapped, and the widths of the upper wide warp yarns and lower wide warp yarns are basically the same.

Embodiment 4 the double-layer structure is that the cross-section of the web has the following arrangement sequence: upper warp yarns in warp yarn sub-units have two wide warp yarns and four narrow warp yarns, the corresponding lower warp yarns have four narrow warp yarns and two wide warp yarns (not shown)

Embodiment 5 the double-layer structure is that the cross-section of the web has the following arrangement sequence: upper warp yarns in warp yarn sub-units have three wide warp yarns and six narrow warp yarns, the corresponding lower warp yarns have six narrow warp yarns and three wide warp yarns (not shown).

The invention claimed is:

1. An industrial fabric which is a web woven from warp yarns made of monofilaments and weft yarns made of monofilaments, wherein, the structure or texture of the warp yarns are of a double-layer structure comprising an upper layer in which upper layer warp yarns interlace with the weft yarns, and a lower layer in which lower layer warp yarns interlace with the weft yarns, wherein the upper layer warp yarns do not intersect with the lower layer warp yarns; one of warp yarn basic units comprises four sub-units, wherein two sub-units are located on the upper layer, the other two sub-units are located on the lower layer, the warp yarns on the upper layer and the warp yarns on the lower layer are vertically overlapped, wherein at least two sub-units comprise two parallel narrow warp yarns; and wherein the warp yarns have flat cross-sections respectively;

upper warp yarns and lower warp yarns are identical in texture structure, or one surface is identical to the other surface after being rotated by 180 degrees; and wherein the double-layer structure is that: one sub-unit of the upper warp yarns has two parallel narrow warp yarns and the other sub-unit also has two parallel narrow warp yarns; one sub-unit of the lower warp yarns has two parallel narrow warp yarns and the other sub-unit also has two parallel narrow warp yarns; the two parallel narrow warp yarns of the upper sub-unit and the two parallel narrow warp yarns of the lower sub-unit are vertically overlapped.

2. The industrial fabric of claim 1, wherein the web is of a web with ends.

3. The industrial fabric of claim 2, wherein the seam structure of the web with ends is a pin loop seam or a spiral loop seam.

4. The industrial fabric of claim 1, wherein the cross-section of the warp yarns is rectangular.

5. The industrial fabric of claim 1, wherein the cross-section of weft yarns is circular or rectangular, of which the diameters or thicknesses are the same or different to each other.

6. The industrial fabric of claim 1, wherein monofilaments are made of polymeric resins, the polymeric resins comprise one or more of polyester monofilaments, PPS monofilaments, PEEK, PCTA and nylon monofilaments.

7. An industrial fabric which is a web woven from warp yarns made of monofilaments and weft yarns made of monofilaments, wherein, the structure or texture of the warp yarns are of a double-layer structure comprising an upper layer in which upper layer warp yarns interlace with the weft yarns, and a lower layer in which lower layer warp yarns interlace with the weft yarns, wherein the upper layer warp yarns do not intersect with the lower layer warp yarns; one of warp yarn basic units comprises four sub-units, wherein two sub-units are located on the upper layer, the other two sub-units are located on the lower layer, the warp yarns on the upper layer and the warp yarns on the lower layer are vertically overlapped, wherein at least two sub-units comprise two parallel narrow warp yarns; and wherein the warp yarns have flat cross-sections respectively;

upper warp yarns and lower warp yarns are identical in texture structure, or one surface is identical to the other surface after being rotated by 180 degrees; and wherein the double-layer structure is that: one sub-unit of the upper warp yarns has one wide warp yarn and the other sub-unit has two narrow warp yarns; one sub-unit of the lower warp yarns has two narrow warp yarns and the other sub-unit has one wide warp yarn; one wide warp yarn on the upper layer and two narrow warp yarns on the lower layer are vertically overlapped, the width of the wide warp yarn is 0.6-1.5 times the sum of the widths of the two narrow warp yarns; two narrow warp yarns on the upper layer and one wide warp yarn on the lower layer are vertically overlapped, the width of the wide warp yarn is 0.6-1.5 times the sum of the widths of the two narrow warp yarns.

8. The industrial fabric of claim 7, wherein the web is of a web with ends.

9. The industrial fabric of claim 8, wherein the seam structure of the web with ends is a pin loop seam or a spiral loop seam.

10. The industrial fabric of claim 7, wherein the cross-section of the warp yarns is rectangular.

11. The industrial fabric of claim 7, wherein the cross-section of weft yarns is circular or rectangular, of which the diameters or thicknesses are the same or different to each other.

12. The industrial fabric of claim 7, wherein monofilaments are made of polymeric resins, the polymeric resins comprise one or more of polyester monofilaments, PPS monofilaments, PEEK, PCTA and nylon monofilaments.

13. An industrial fabric which is a web woven from warp yarns made of monofilaments and weft yarns made of monofilaments, wherein, the structure or texture of the warp yarns are of a double-layer structure comprising an upper layer in which upper layer warp yarns interlace with the weft yarns, and a lower layer in which lower layer warp yarns interlace with the weft yarns, wherein the upper layer warp yarns do not intersect with the lower layer warp yarns; one of warn yarn basic units comprises four sub-units, wherein two sub-units are located on the upper layer, the other two sub-units are located on the lower layer, the warp yarns on the upper layer and the warp yarns on the lower layer are vertically overlapped, wherein at least two sub-units comprise two parallel narrow warp yarns; and wherein the warp yarns have flat cross-sections respectively;

upper warp yarns and lower warp yarns are identical in texture structure, or one surface is identical to the other surface after being rotated by 180 degrees; and wherein the double-layer structure is that: one sub-unit of the upper warp yarns has one wide warp yarn and the other sub-unit has two narrow warp yarns; one sub-unit of the lower warp yarns has two narrow warp yarns and the other sub-unit has one wide warp yarn; one wide warp yarn on the upper layer and one wide warp yarn on the lower layer are vertically overlapped; two narrow warp yarns on the upper layer and two narrow warp yarns on the lower layer are vertically overlapped.

14. The industrial fabric of claim 13, wherein the web is of a web with ends.

15. The industrial fabric of claim 14, wherein the seam structure of the web with ends is a pin loop seam or a spiral loop seam.

16. The industrial fabric of claim 13, wherein the cross-section of the warp yarns is rectangular.

17. The industrial fabric of claim 13, wherein the cross-section of weft yarns is circular or rectangular, of which the diameters or thicknesses are the same or different to each other.

18. The industrial fabric of claim 13, wherein monofilaments are made of polymeric resins, the polymeric resins comprise one or more of polyester monofilaments, PPS monofilaments, PEEK, PCTA and nylon monofilaments.

* * * * *